US012796764B2

(12) United States Patent
Sample et al.

(10) Patent No.: US 12,796,764 B2
(45) Date of Patent: Nov. 17, 2026

(54) FIT SYSTEMS FOR HELMETS

(71) Applicant: Boa Technology, Inc., Denver, CO (US)

(72) Inventors: Benjamin R. Sample, Denver, CO (US); Mark J. Kerns, Golden, CO (US); Taylor James Ditallo, Denver, CO (US); Veronica A. Hogg-Cornejo, Denver, CO (US); Grace Derrer, Denver, CO (US); Jesse D. Cotterman, Evergreen, CO (US); Michael J. Nickel, Golden, CO (US)

(73) Assignee: BOA Technology, Inc., Denver, CO (US)

( * ) Notice: Subject to any disclaimer, the term of this patent is extended or adjusted under 35 U.S.C. 154(b) by 0 days.

(21) Appl. No.: 19/061,790

(22) Filed: Feb. 24, 2025

(65) Prior Publication Data

US 2025/0359616 A1 Nov. 27, 2025

Related U.S. Application Data

(60) Provisional application No. 63/745,112, filed on Jan. 14, 2025, provisional application No. 63/557,315, filed on Feb. 23, 2024.

(51) Int. Cl.
*A42B 3/08* (2006.01)

(52) U.S. Cl.
CPC ..... *A42B 3/085* (2013.01)

(58) Field of Classification Search
CPC ..... A42B 3/085; A42B 3/145; F16H 1/16; F16H 1/203; F16H 1/333; F16H 1/22; A43C 11/165
See application file for complete search history.

(56) References Cited

U.S. PATENT DOCUMENTS 5,794,272 A * 8/1998 Workman ..... A42B 3/085 2/421
9,179,729 B2 * 11/2015 Cotterman ..... A42B 3/08
11,357,279 B2 * 6/2022 Cotterman ..... A42B 3/064
11,457,684 B2 * 10/2022 Maloney ..... A42B 3/145
(Continued)

FOREIGN PATENT DOCUMENTS

WO 2015174626 A1 11/2015

OTHER PUBLICATIONS

International Search Report with accompanying Written Opinion, mailed on Jun. 9, 2025, in corresponding International Patent Application No. PCT/US2025/017068, 11 pages.

*Primary Examiner* — Katherine M Moran
(74) *Attorney, Agent, or Firm* — Kilpatrick Townsend & Stockton LLP; Clark F. Weight

(57) ABSTRACT

A rear support of a helmet closure system includes a frame and a pair of arms. The frame has an upper end and a lower end with the lower end including a base member of a reel based closure device. The pair of arms are attached to the upper end of the frame and each arm of the pair of arms includes one or more guides that are configured to direct or route a tension member along a path. A lower end of each arm is typically separated from the lower end of the frame. The rear support also includes attachment means, such as longitudinally aligned grooves or recesses, that are positioned at the upper end of the frame. The attachment means enable the rear support to be coupled with a helmet.

12 Claims, 8 Drawing Sheets

(56) References Cited

U.S. PATENT DOCUMENTS

| | | | | |
|---|---|---|---|---|
| 11,666,112 | B2 * | 6/2023 | Rogers | A42B 3/145 2/417 |
| 11,719,311 | B2 * | 8/2023 | Fiegener | A42B 3/145 242/395 |
| 2007/0245466 | A1 | 10/2007 | Lilenthal et al. | |
| 2017/0251746 | A1 | 9/2017 | Staudinger | |
| 2017/0273390 | A1 * | 9/2017 | Maloney | A42B 3/142 |
| 2018/0325203 | A1 | 11/2018 | Cotterman | |
| 2021/0100309 | A1 * | 4/2021 | Maloney | F16B 5/0642 |
| 2022/0315378 | A1 * | 10/2022 | Fiegener | A41F 1/00 |
| 2023/0180878 | A1 * | 6/2023 | Robbins | A42B 3/145 2/418 |
| 2023/0380535 | A1 * | 11/2023 | Maloney | A42B 3/065 |
| 2025/0241398 | A1 * | 7/2025 | Fiegener | A42B 3/14 |

* cited by examiner

FIT SYSTEMS FOR HELMETS

CROSS-REFERENCE TO RELATED APPLICATIONS

This application claims priority to Provisional U.S. Patent Application No. 63/557,315 filed Feb. 23, 2024, entitled "FIT SYSTEMS FOR HELMETS" and Provisional U.S. Patent Application No. 63/745,112 filed Jan. 14, 2025, entitled "FIT SYSTEMS FOR HELMETS." The entire disclosure of both of the aforementioned Provisional U.S. Patent Applications are hereby incorporated by reference, for all purposes, as if fully set forth herein.

BACKGROUND

Headwear and helmets are often worn by wearer's for various reasons, such as to protect the head from impact or contact with surrounding objects. For example, helmets are typically worn in competition sports to protect and shield a wearer's head and thereby reduce or prevent injury to the head. Helmets are also commonly employed in non-sport environments, such as in combatant or law enforcement situations.

Regardless of the situation, it is often important to secure the headwear to the wearer's head to ensure that the headwear will not fall off during use. Conventional methods of securing the headwear to the head include the use of chin straps and/or other straps that encircle the head. Conventional straps, however, may be relatively uncomfortable due to the inability to quickly and conveniently adjust the strap. These and/or other issues may result in users neglecting to wear the headwear and/or in wearer's not wearing the headwear properly.

BRIEF DESCRIPTION OF THE INVENTION

The embodiments described herein are directed to closure systems for headwear. The closure systems are usable to tighten or tension the headwear about a wearer's head. According to one aspect, a rear support of a helmet closure system is described. The rear support is positionable at a rear of a helmet and is configured to engage a back of a wearer's head. The rear support includes a central frame having an upper end and a lower end. The lower end includes a base member of a reel based closure device. The rear support also includes a pair of arms that are attached to the central frame at the upper end thereof. Each arm includes one or more guides that are configured to direct or route a tension member of the reel based closure device along a path. The rear support further includes attachment means that are positioned at the upper end of the central frame. The attachment means enable the rear support to be coupled with the helmet.

Each arm may be attached to the central frame only at the upper end so that the lower end of the central frame is separated from a lower end of each arm. Each arm also includes a distal end that extends away from the central frame so as to encircle a portion of the wearer's head when the helmet is being worn. The central frame and pair of arms are typically formed of thin and flat polymer materials that enable the central frame and pair of arms to lie flat against and conform to the back of the wearer's head.

The central frame and the pair of arms are typically curved in a first plane and are curved in a second plane that is orthogonal to the first plane. In some embodiments, each arm includes a gap between a first arm segment and a second arm segment. The second arm segment may be attached to the first arm segment near a midpoint thereof. In such embodiments, the second arm segment may extend from the first arm segment and toward the lower end of the central frame so that an end of the second arm segment is vertically separated from the first arm segment. The second arm segment of each arm may be positioned with respect to the base member of the central frame so that lace ports of the base member are aligned with the second arm segment of each arm.

In other embodiments, the second arm segment may be attached to the first arm segment at a distal end thereof. In such embodiments, the second arm segment may extend from the first arm segment and away from the central frame so that an end of the second arm segment is horizontally separated from the first arm segment. The attachment means may be positioned on a thin rectangularly shaped segment that extends from the upper end of the central frame. The attachment means may include or consists of one or more bosses or posts, a hook and loop fastener, a magnet, a button, an adhesive, or a combination thereof.

According to another aspect, a rear support of a helmet closure system includes a frame having an upper end and a lower end with the lower end including a base member of a reel based closure device. The rear support also includes a pair of arms that are attached to the frame at the upper end thereof. Each arm of the pair of arms includes one or more guides that are configured to direct or route a tension member along a path. The rear support further includes attachment means that are positioned at the upper end of the frame. The attachment means enable the rear support to be coupled with a helmet. A lower end of each arm may be separated from the lower end of the frame.

The frame and the pair of arms may be curved in a first plane and in a second plane. Each arm of the pair of arms may include a gap between a first arm segment and a second arm segment. The second arm segment may be attached to the first arm segment near a midpoint thereof and the second arm segment may be vertically separated from the first arm segment. Alternatively, the second arm segment may be attached to the first arm segment at a distal end thereof. The second arm segment may be positioned so that lace ports of the base member are aligned with the second arm segment of each arm. The attachment means may be positioned on a thin rectangularly shaped segment that extends from the upper end of the frame. The attachment means may include or consist of one or more bosses or posts, a hook and loop fastener, a magnet, a button, an adhesive, or a combination thereof.

According to another aspect, a forehead strap of a helmet closure system is described. The forehead strap is positioned at a front of a helmet and is configured to engage a front of a wearer's head. The forehead strap includes a strap body having a first end, a second end, and a midpoint positioned centrally between the first end and the second end. The forehead strap also includes a plurality of openings that are positioned longitudinally along the strap body and that are positioned on opposing sides thereof in an alternating fashion such that the strap body is able to flex or move in an accordion like manner. The forehead strap further includes a first guide that is positioned on the first end of the strap body and a second guide that is positioned on the second end of the strap body. The first guide and the second guide are configured to direct or route a tension member along a path and the strap body is formed of thin and flat polymer material that enables the strap body to lie flat against and conform to the front of the wearer's head.

Each opening may have a generally parabolic shape with a circular center, a tapered midsection, and an outwardly flared end. The strap body may be configured for removable attachment to a mounting piece that is attached to the helmet. One or more openings of the plurality of openings may be configured so that the mounting piece is insertable within one of the openings to removably attach the strap body to the mounting piece. The mounting piece may be insertable within a centermost positioned opening of the plurality of openings and may also be insertable within each opening positioned on opposing sides of the centermost positioned opening so that the mounting piece is laterally adjustable along a longitudinal length of the strap body. The strap body may be reinforced adjacent the centermost positioned opening to reinforce a coupling of the mounting piece within the centermost positioned opening.

A shape and size of the mounting piece may be inverse that of the openings so that the mounting piece is insertable within one of the openings in a keyed or locking manner. The plurality of openings and the mounting piece may each have a generally parabolic shape with a circular portion, a tapered midsection, and flared end. In such embodiments, the openings and mounting piece may be shaped and sized such that insertion of the mounting piece within an opening restricts and/or inhibits rotation of the strap body about the mounting piece in at least one plane. The mounting piece may include a stop feature that it is able to snap or fit over an upper end of an opening of the plurality of openings to fasten or secure the mounting piece to the strap body. The opening may include a tapered recess or groove along which the stop feature slides as the mounting piece is inserted within the opening.

According to another aspect, a forehead strap of a helmet closure system includes a strap body having a longitudinal length and opposing ends. The forehead strap also includes a plurality of openings that are positioned along the longitudinal length of the strap body and on opposing sides thereof in an alternating fashion. The forehead strap further includes at least one guide positioned on an end of the strap body. The at least one guide is configured to direct or route a tension member along a path and the strap body is formed of thin and flat material.

Each opening may have a generally parabolic shape with a circular center, a tapered midsection, and an outwardly flared end. The strap body may be configured for removable attachment to a mounting piece that is attached to the helmet. One or more openings may be configured so that the mounting piece is insertable within the one or more openings to removably attach the strap body to the mounting piece. In some embodiments, the mounting piece may be insertable within a centermost positioned opening of the plurality of openings and may also be insertable within each opening positioned on opposing sides thereof.

The strap body may be reinforced adjacent a centermost positioned opening of the plurality of openings. The mounting piece may be shape and size such that the mounting piece is insertable within one of the openings in a keyed or locking manner. The plurality of openings and the mounting piece may each have a generally parabolic shape so that insertion of the mounting piece within an opening restricts and/or inhibits rotation of the strap body about the mounting piece. The mounting piece may include a stop feature that snaps or fits over an upper end of an opening of the plurality of openings. The opening may include a tapered recess or groove along which the stop feature is slidable.

According to another aspect, a helmet closure system is described. The helmet closure system includes a reel based closure device, a tension member that is operably coupled with the reel based closure device, a rear support, and a forehead strap. The rear support includes a frame that is configured to support a base member of the reel based closure device. The rear support also includes a pair of arms that are attached to the frame and attachment means that enable the rear support to be coupled with a helmet. Each arm includes one or more guides that are configured to direct or route the tension member. The forehead strap includes a strap body having a longitudinal length and a plurality of openings that are positioned along the longitudinal length of the strap body and on opposing sides thereof in an alternating fashion. The forehead strap also includes a first guide positioned on a first end of the strap body and a second guide positioned on a second end of the strap body. The first guide and the second guide are configured to direct or route the tension member.

The helmet closure system also typically includes a mounting piece that is attachable to the helmet and that is insertable within one of the openings of the plurality of openings of the forehead strap. The forehead strap may be only directly coupled with the helmet via the mounting piece. A distal end of each arm of the rear support may be attachable to the helmet and may include a thru hole through which the tension member is insertable.

BRIEF DESCRIPTION OF THE DRAWINGS

The present invention is described in conjunction with the appended figures.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE DRAWINGS

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein are directed to closure systems for headwear. The closure systems are usable to tighten or tension the headwear about a wearer's head. Common examples of headwear include cycling helmets, ski and snowboard helmets, safety helmets (e.g., hard hat), military helmets, and the like. For ease in describing the embodiments herein, the headwear will be generally referred to as a helmet.

The closure system is configured to tighten about the wearer's head to improve the fit of the helmet about the head. In addition, the closure system may be configured to aid in comfort so that wearing the headwear is not uncomfortable or irritating to the wearer. For example, the closure system may be designed to apply limited pressure to sensitive nerves and/or blood vessels.

The closure system employs a tightening mechanism that is operable by the wearer to tension a tension member, such as a lace, cord, or strap that is routed or guided about the headwear by one or more guides. In exemplary and non-limiting embodiments, the tightening mechanism is a reel based closure device that includes a dial or knob that the wearer may grasp and rotate to tension the lace. Exemplary embodiments of reel based closure devices are further described in U.S. Pat. No. 10,076,160, issued Sep. 18, 2018, titled "Integrated Closure Device Components and Methods", U.S. Pat. No. 11,492,228, issued Nov. 8, 2022, titled "Reel Based Closure System," and U.S. Pat. No. 10,842,230, issued Nov. 24, 202, titled "Reel Based Closure System", the entire disclosures of which are incorporated by reference herein. For ease is describing the various embodiments herein, the tightening mechanism will be referred to generally as a "reel based closure device" or simply "closure device".

Figure 1:
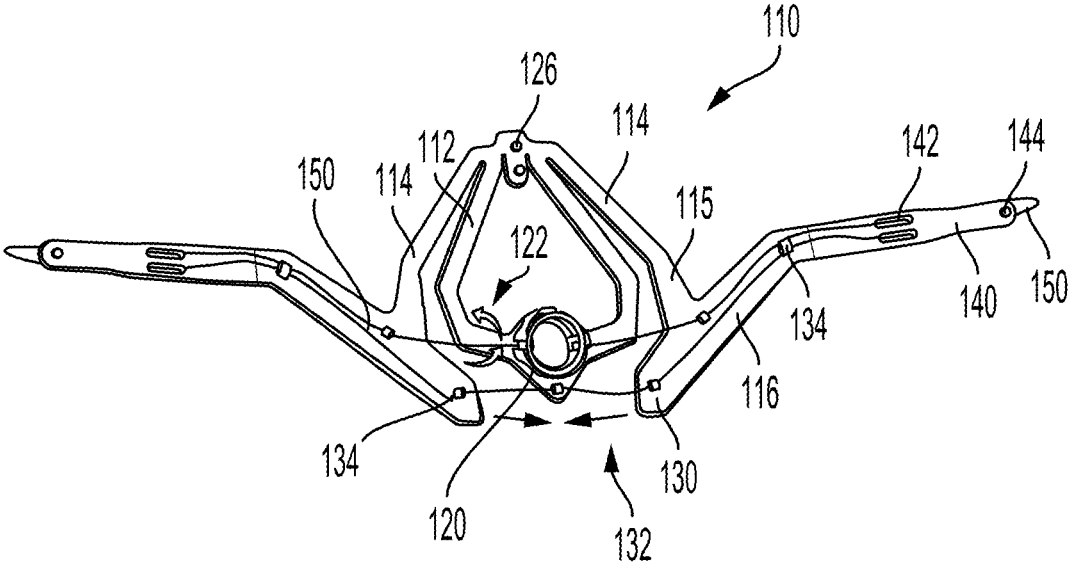
FIG. 1 illustrates a first embodiment of a rear support or yoke of a helmet closure system.

Referring to FIG. 1, illustrated is a rear support or yoke 110 of the closure system. The yoke 110 is positionable at the rear of the helmet and is designed to engage the back of the wearer's head, such as at the base of the head near the neck. The yoke 110 includes a central frame or center member 112 (hereinafter frame or center member 112) and a pair of arms 114 that are coupled or attached to the center member 112 at an upper end of the center member 112. The center member 112 and pair of arms 114 are typically made of thin and flat materials, such as various polymers. The thin and flat design allows the center member 112 and pair of arms 114 to lie flat against the wearer's head and to conform to the individual shape of the wearer's head. The center member 112 and the pair of arms 114 are typically curved in a first plane and are curved in a second plane that is orthogonal to the first plane (see FIG. 10*c*).

A center portion 115 of each arm 114 extends downward so that the pair of arms 114 encircles a majority of the center member 112. The center portion 115 of the arms 114, however, are typically not attached or coupled at the bottom end 130 of the arm 114, which allow the arms 114 to move and flex during operation of the closure system as described herein. Stated differently, each arm 114 may be attached to the central member 112 only at the upper end so that the lower end of the central member 112 is separated from the bottom end 130 of each arm 114. A proximal portion 116 of each arm 114 extends away from the center member 112 in opposite directions. A distal portion 140 of each arm 114 extends away from the respective proximal portion 116 in opposite directions. The proximal portion 116 and distal portion 140 of the arms 114 encircles a portion of the wearer's head, typically up to or past the wearer's ears.

The center member 112 typically has a hollow or open interior, although the interior may include one or more material segments or pieces that are positioned in the interior as desired. In some instances, the center member 112 may have a relatively triangular or diamond shape. A bottom end of the center member 112 includes a base member 120 or bayonet that is designed to releasably couple with the reel based closure device (see reel based closure device 160 of FIG. 5). The use of the base member 120 enables the reel based closure device to be removed from the yoke 110 for replacement, repair, and the like. The yoke 110 also includes attachment means 126 that are positioned at the upper end of the center member 112 adjacent to the coupling point of the center member 112 and pair of arms 114. The attachment means 126 enables the yoke 110 to be attached to a rear portion of the helmet. In many embodiments, the attachment means 126 also enables a position of the yoke 110 to be adjusted relative to the helmet so that the yoke 110 is positioned differently about the wearer's head for comfort and/or fit purposes. The attachment means 126 could include one or more bosses or posts that are configured to snap into corresponding recesses of the helmet (not shown) or could include hook and loop fasteners, magnets, buttons, adhesive based attachments, and the like.

The thin and flat materials of the center member 112 and pair of arms 114 allows the center member 112 and pair of arms 114 to move, twist, contort, and the like as the helmet is worn. For example, as the tension member 150 is tensioned to tighten helmet against the wearer's head, the center member 112 is pressed inwardly against the rear of the head. The bottom end of the center member 112, and/or other portions of the center member 112, is able to flex, twist or rotate so that increased contact between the center member 112 and the wearer's head is achieved. This movement and flexibility increases occipital bone conformity. An example of such rotation is illustrated by arrows 122 in FIG. 1. Portions of the pair of arms 114 may similarly move, rotate, twist, contort, and the like to enable the yoke 110 to move fully conform to the wearer's head. In addition, the separation of the center member 112 and the pair of arms 114 allows each component to move, flex, twist and/or rotate relatively independently, which allows each component, and more particularly the pair of arms 114, to conform to the wearer's head to a greater degree than a solitary design would.

A distal or bottom end 130 of each arm 114 is positioned adjacent to the bottom end of the center member 112. The bottom end 130 of each arm 114 is separated by a gap, which may be between 0.5 and 3 inches, although the gap is more commonly between 0.5 and 2 inches or even 0.5 and 1.5 inches. In some embodiments, the gap between the bottom end 130 of each arm is roughly the same as a maximum width of the center member 112. The bottom end 130 of each arm 114 includes a guide 134 that is designed to route, guide, or direct the tension member 150 along a path about the arm 114. The center member 112 similarly includes a guide 134 that is positioned on a flange or tab that extends downward from the base member 120. As illustrated in FIG. 1, the tension member 150 is guided, via the guides 134, between the bottom end 130 of each arm 114 and the flange or tab of the center member 112. The tension member 150 spans the gap between the bottom end 130 of each arm 114. As such, when the tension member 150 is tensioned, the bottom end 130 of each arm 114 is pulled inward 132 towards the flange or tab of the center member 112. This movement causes the bottom end 130 of each arm 114 to be pressed against the occipital bone of the wearer's head, which help ensure that the helmet is fit snuggly against the wearer's head. In this manner, the bottom end 130 of each arm 114 functions as a lock type mechanism.

The proximal portion 116 of each arm 114 extends away from the bottom end 130 in opposite directions. The proximal portion 116 of each arm 114 is typically angled upward from the bottom end 130. The proximal portion 116 may be angled between 30 and 60 degrees, and more commonly between 40 and 50 degrees, relative to the bottom end 130. The distal portion 140 of each arm 114 extends from the proximal portion 116 and is angled relative thereto. An angle formed between the proximal portion 116 and the distal portion 140 may be between 120 and 150 degrees and more commonly between 130 and 140 degrees. The intentional angling of the proximal portion 116 from the bottom end 130 and the intentional angling of the distal portion 140 from the proximal portion 116 precludes the arms 114 from resting on or pressing against the wearer's ears and/or other sensitive portions of the head, thereby increasing comfort. The proximal portion 116 and distal portion 140 each typically include guides 134 that route, guide, or direct the tension member 150 about or along a path of the arms 114. The guides 134 may be designed to route a single portion of the tension member 150 or multiple portions of the tension member 150 as illustrated in FIG. 1.

As further illustrated in FIG. 1, the tension member 150 is commonly routed atop a majority of the length of the arms 114, although in some instances the tension member 150 may be routed under a majority of the length of the arms 114. The guides 134 are arranged along the arms 114 so that the path of the tension member 150 follows the shape of the arms 114. Positioning the tension member 150 atop the arms 114 causes the arms to be pressed inward against the wearer's head as the tension member 150 is tensioned. For example, tensioning the tension member 150 causes the tension member to constrict about the wearer's head. With the tension member 150 positioned atop the arms 114, the arms are forced radially inward against the head. Thus, the tension member 150 is prevented from directly contacting the head, which minimizes or eliminates discomfort to the wearer.

A distal end of each arm 114 includes attachment means 144 that enable the distal end of each arm 114 to be coupled or attached to the helmet. The attachment means 144 could include one or more bosses or posts that are configured to snap into corresponding recesses of the helmet. The attachment means 144 could also include hook and loop fasteners, magnets, buttons, adhesive based attachments, and the like. Alternatively, the attachment means 144 could include the coupling member 400 illustrated in FIG. 8.

To enable the distal end of each arm 114 to be coupled with the helmet while the arms 114 are pressed inward against the wearer's head, the distal portion 140 of each arm 114 includes one or more openings 142 through which the tension member 150 is inserted. The openings 142 allow the tension member 150 to be routed from atop the arms 114 to underneath the arms 114. When the tension member 150 is tensioned, the arms 114 flex at or near the openings 142 and transition from contact with the wearer's head to attachment with the helmet. The one or more openings 142 typically have an elongate or oval opening, which enables greater movement of the tension member 150 through the openings 142.

The yoke 110 is suspended within the helmet between the contact or coupling points of the attachment means, 126 and 142. A length of each arm 114 from the bottom end 130 to the distal end of the arm adjacent the attachment means 144 may be at least 3 inches, and in some instances at least 4 inches. In some embodiments, the length of each arm 114 between these points may be between 3 and 8 inches, 4 and 7 inches, or between 5 and 6 inches. These lengths provide a better fit about the wearer's head by circumscribing the head to a greater degree than conventional arms and by flexing inward against the wearer's head. The openings 142 of each arm 114 may be positioned between 0.5 and 2 inches from the attachment means 144, and more commonly between 0.5 and 1.5 inches or between 0.75 and 1.25 inches.

In use, the arms 114 are designed to achieve strategically positioned closure zones that increase compliance for better conformity and fit of the helmet about a wearer's head. The closure zones, when activated by the reel based closure device, offer compression against the wearer's head. When not activated by the reel based closure device, the closure zones are able to expand away from the wearer's head. These functions of the closure zones accommodate a wider range of head volumes and shapes for a premium fit experience.

In addition, the arms 114 are semi rigid and maintain relatively the same length during untightened and tightened states. The relatively long length of the arms 114 increases the surface area of the yoke 110 that is able to contact the sides and back of the wearer's head, which distributes pressure over a greater area and reduces pressure points. In contrast, conventional yokes that employ shorter yoke arms or yoke arms that retract (shorten) when tightened, such as conventional front-back compression designs, reduce the surface area that is in contact with the wearer's head, which increases and localizes the pressure on the wearer's head. These conventional designs cause or create pressure points along the wearer's head. In addition, the length of the arms 114 and the strategic position of the openings 142 and attachment means 144 provide increased contact of the arms 114 along the sides of the wearer's head. As tension is applied to the tenson member 150 to close the system, the long arms 114 are able to flex/move centrally closer to the sides of the wearer's head.

As briefly mentioned, the split center member 112 and arms 114 allows for independent movement of the arms 114 from the center member 112 and reel based closure device, which improves the closure of the system about the wearer's head and the overall conformity to the occipital bone at the back of the wearer's head. The routing of the tension member 150 atop the arms 114 and the position of the openings 142 cause the tension member 150 to be shielded from direct contact with the wearer's head until near the distal end of the arms 114 where the arms 114 are anchored to the helmet via the attachment means 144. This design avoids contact of the tension member 150 with sensitive areas of the head.

Figure 2A:
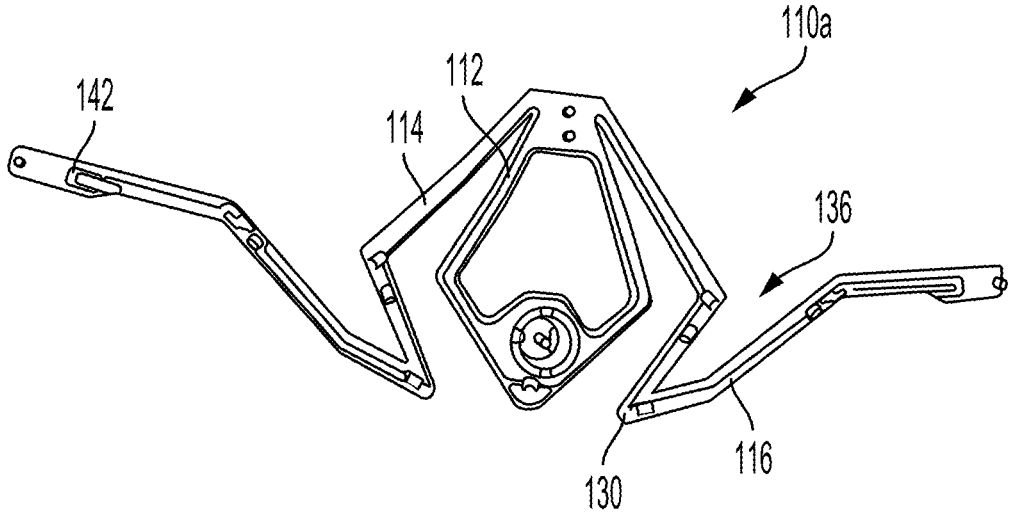
FIGS. 2*a-b* illustrate a second embodiment of a rear support or yoke of a helmet closure system.

FIG. 2*a* illustrates an alternative design of the yoke 110*a*. The alternative yoke 110*a* is substantially the same as the yoke 110 of FIG. 1 and thus, for brevity purposes, a detailed description of the alternative yoke 110*a* is omitted. However, it should be recognized that the description of the yoke 110 of FIG. 1 is equally applicable to the alternative yoke 110*a* except in the different features described herein below.

The alternative yoke 110*a* includes a center member 112 and a pair or arms 114 that are substantially similar to those previously describes. The arms 114 includes guides (not numbered) that direct, guide, or route the tension member as previously described. A main difference between the yoke 110 of FIG. 1 and the alternative yoke 110*a* is the inclusion of a gap 136 between the bottom end 130 and the proximal portion 116 of the arms 114. The gap 136 allows the proximal portion 116 to move, flex, bend, or otherwise conform to the wearer's head to a greater degree than the yoke 110 of FIG. 1. The arms 114 of the alternative yoke 110*a* may also include additional guides 134 to ensure that the tension member 150 remains routed along and atop the arms 114. The one or more openings 142 may also be positioned slightly closer to the attachment means 144 in comparison with the yoke 110 of FIG. 1. The tension member 150 may be routed or directed so that it spans the gap 136 between the bottom end 130 and the proximal portion 116 of the arms 114.

Figure 2B:
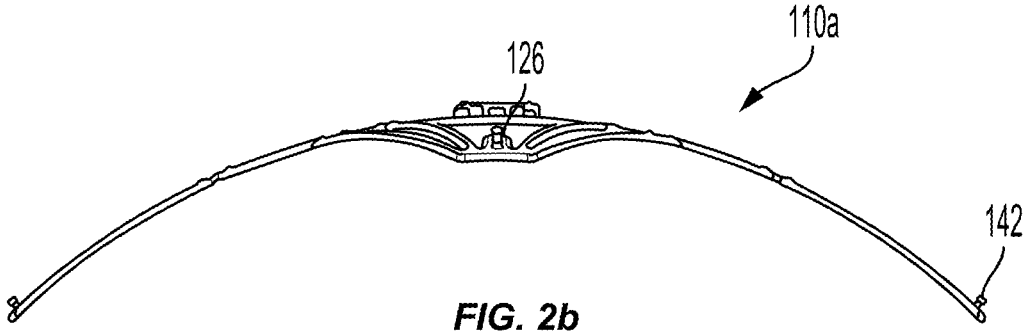

FIG. 2*b* illustrates a top view of the alternative yoke 110*a*. FIB. 2*b* illustrates a flexure of the elongate arms when the tension member 150 is tensioned. The flexibility of the yoke 110*a* allows the arms to more fully wrap around, and conform to, the wearer's head. The flexibility of the arms illustrated in FIG. 2*b* is representative of the flexibility that is achieved in each of the yoke designs described herein.

Figure 3:
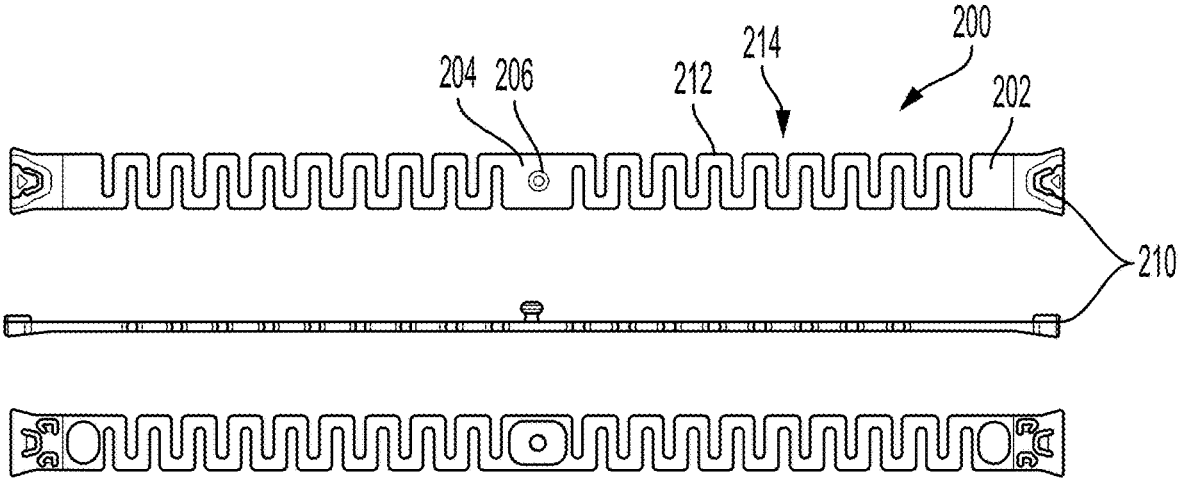
FIG. 3 illustrates a front support member or forehead strap of a helmet closure system.

Referring now to FIG. 3, the closure system also includes a front support member or forehead strap 200 (hereinafter forehead strap 200) that is configured to extend generally horizontally across the wearer's forehead. The forehead strap 200 is designed to stretch or flex as the forehead strap 200 is tensioned via the tension member. In some instances, the forehead strap 200 is a complaint mechanism that includes one or more cutouts, relief cuts, holes, or openings that enable a relatively solid material strap or segment to bend, flex, and move in a compliant manner. The forehead strap 200 can be removably secured to an inner surface or portion of the helmet via attachment means 206 that are positioned on a central section 204 of the forehead strap 200. The attachment means 206 could be a post or boss that extends upward from the central section 204 to provide a snap-fit coupling as illustrated in FIG. 3, or the attachment means 206 could include an adhesive, hook and loop fastener, magnetic fastener, friction-fit, or the like.

Opposing ends of the forehead strap 200 include lace guides 210 that are designed to route, direct, or guide the tension member 150 along a path within the helmet. The lace guides 210 may include an open end or opening that allows a loop of the tension member 150 (e.g., see FIG. 1) to be positioned within the lace guide 210 and removed therefrom. In this manner, the tension member 150 may be easily coupled with the lace guide 210 and removed therefrom. Tensioning of the tension member 150 causes the forehead strap 200 to be pulled generally backwards towards the yoke 110 and against the wearer's head.

As briefly mentioned, the forehead strap 200 is a non-rigid material segment that promotes stretch and conformity along the length of the forehead strap 200. More specifically, the forehead strap 200 is activated and lengthened along the sides of the wearer's head as the tension member 150 is tensioned. This promotes or bolsters a 360 degree feeling of fit about the wearer's head. In the illustrated embodiment, the lengthening of the forehead strap 200 is achieved by forming or cutting slots or openings 214 (hereinafter slots 214) along the longitudinal length of the forehead strap 200. The slots 214 are positioned on opposing sides of the forehead strap 200 in alternating fashion, which results in the forehead strap 200 having or defining a plurality of U-shaped segments 212 along its longitudinal length. As the opposing ends of the forehead strap 200 are tensioned, the individual U-shaped segments widen slightly due to the bending forces imparted on the arms of each U-shaped segment. The slight widening of each U-shaped segment enables an overall length of the forehead strap 200 to lengthen or increase, which helps the strap to conform to the wearer's forehead. The forehead strap 200 is made of a compliant material such that when tension is released in the tension member 150, the forehead strap 200 shortens and resumes an untensioned shape and length. The compliant nature or function of the forehead strap 200 may be achieved via one or more polymer materials or a combination of polymer materials.

The flexibility of the forehead strap 200 allows the forehead strap 200 to mimic or match a contour of the wearer's head, which helps alleviate pressure points. The stretch by the forehead strap 200 allows shorter lengths of tension member 150 to be employed to close and tighten the helmet about the wearer's head. The shorter tension member lengths in combination with the flexible forehead strap 200 provides a high-resolution adjustment with each turn of the reel based closure device's dial. The wearer is thus provided with improved closure refinement, which enables an ideal fit to be achieved without rapidly over tightening or loosening the system. In addition, in many embodiments both ends of the tension member 150 are coupled with the reel based closure device rather than having ends that terminate with or on a component of the closure system, such as the yoke arms or forehead strap. This dual lace path configuration further improves the tightening resolution, which can be twice as resolving in comparison with conventional single lace path configurations.

Figure 4:
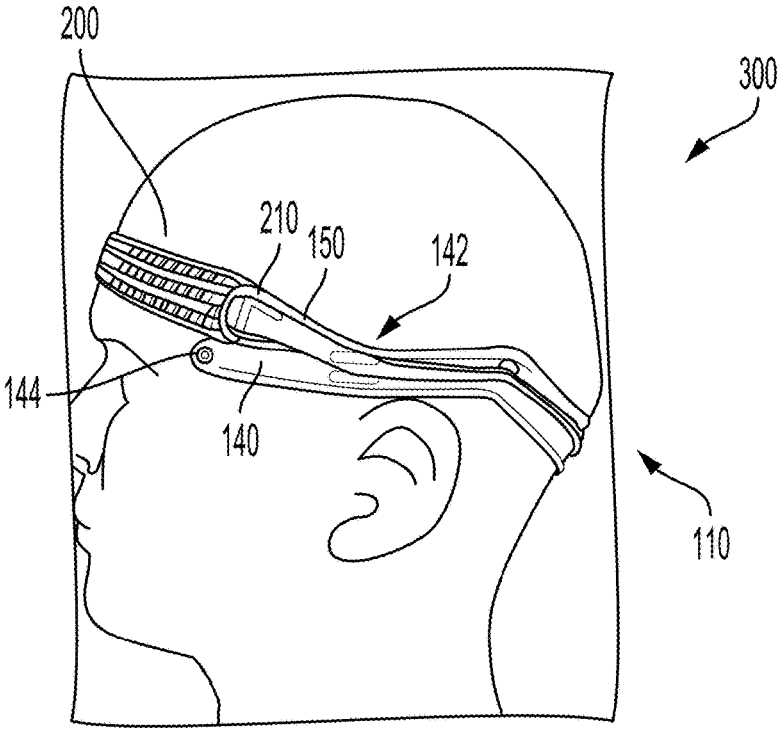
FIG. 4 illustrates a first embodiment of a helmet closure system.

Referring now to FIG. 4, illustrated is an embodiment of the closure system 300 with the helmet removed. The system 300 comprises or consists of the yoke 110, the forehead strap 200, and the tension member 150. The tension member 150 extends between the yoke 110 and the forehead strap 200. In some embodiments, separate tension members 150 can be used for attachment to the left and right sides of forehead strap 200. Typically, however, a single tension member 150 is attached to both the left and right sides of the forehead strap 200 and to the reel based closure device. In such instances, opposing ends of the single tension member 150 are attached to the reel based closure device. In such instances, the tension member 150 is routed between the left and rights sides of the forehead strap 200, across the gap between the bottom end 130 of each arm 114, and underneath the reel based closure device.

The distal portion 140 of each arm 114 extends upward from the bottom end 130 of the respective arm 114. The distal portion 140 of each arm 114 wraps around the back of the wearer's head to distribute the tightening force across the back and sides of the head. The yoke 110 is removably attached to the helmet via the attachment means 126. The forehead strap 200 is similarly attached to the helmet via the attachment means 206. The tension member 150 forms a loop that extends to both sides of the forehead strap 200 and is inserted within the lace guides 210 on the distal ends of the forehead strap 200. In some instances, the tension member 150 spans a gap between the distal portion 140 of each arm 114 and the lace guide 210 of the forehead strap 200. In other instances, however, the forehead strap 200 and the distal end of each arm 114 overlap to some degree, such as the embodiment illustrated in FIG. 4. The stretch or flexibility of the forehead strap 200 leads to more overlap of the strap 200 and the distal end of each arm 114. Overlapping the ends of the forehead strap 200 and arms 114 minimizes or eliminates an amount of the tension member 150 that is directly pressed against the wearer's skin, which contact can cause pain and/or become tangled with hair. The openings 142 of the arms 114 are illustrated in FIG. 4, which serve as a point where the tension member 150 deviates from a path along the arms 114 and is routed toward the distal end of the forehead strap 200.

In addition, the number of anchor points that couple the forehead strap 200 and yoke 110 to the helmet is selected to create a desired suspension of the system 300 within the helmet. For example, by strategically placing anchor points around the circumference of the wearer's head, the head is held within the suspension system for a secure fit instead of becoming wedged against the rigid helmet shell. As the tension member 150 is tightened, the yoke 110 can be pulled forward towards the forehead strap 200 and the forehead strap 200 is similarly pulled rearward toward the yoke 110. The arms 114 flex inward toward the sides of the wearer's head.

Figure 5:
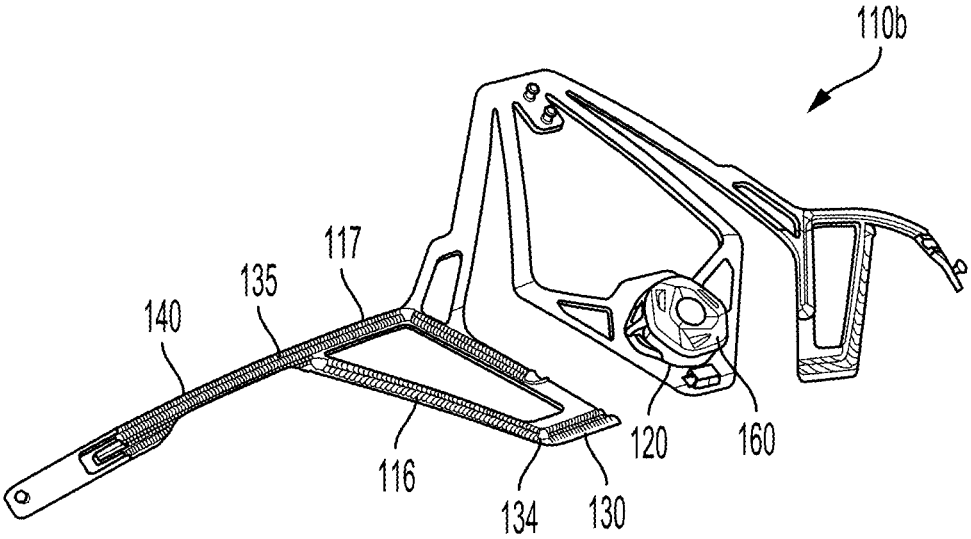
FIG. 5 illustrates a third embodiment of a rear support or yoke of a helmet closure system.

FIG. 5 illustrates another alternative design of the yoke 110*b*. The alternative yoke 110*b* is substantially the same as the yoke 110*a* of FIG. 2*a* and thus, for brevity purposes, a detailed description of the alternative yoke 110*b* is omitted. However, it should be recognized that the description of the yoke 110*a* of FIG. 2*a* and the description of the yoke 110 of FIG. 1 is equally applicable to the alternative yoke 110*b* of FIG. 5 except where different features are described herein below.

A main difference between the yoke 110*b* of FIG. 5 and the yoke 110*a* of FIG. 2*a* is the inclusion of a beam or member 117 that spans the gap 136 between the bottom end 130 and the proximal portion 116 of the arms 114. The beam 117 reinforces the arms by spanning the gap 136 and by being fixedly attached to the distal portion 140 of the arm 114. The arms 114 may include a hollow interior or opening that is defined or formed by the beam 117 and the proximal portion 116. In some instances, one or more of the beam 117, the proximal portion 116, the distal portion 140, and/or the bottom portion may include channels 135 within which the tension member 150 is positioned to route or direct the tension member along the path of the arms 114 while preventing direct contact with the wearer's head. The channels 135 may be open so that the tension member 150 may be easily removed from the channels, or the channels 135 may be closed so that the tension member is enclosed within the channels. FIG. 5 further illustrates a reel based closure device 160 that is attached to the base member 120 on the bottom end of the center member 112. As described herein, the reel based closure device 160 may be operated by the wearer to adjust the tension in the tension member 150. The reel based closure device 160 illustrated in FIG. 5 may be employed in any of the closure systems described herein.

Figure 6A:
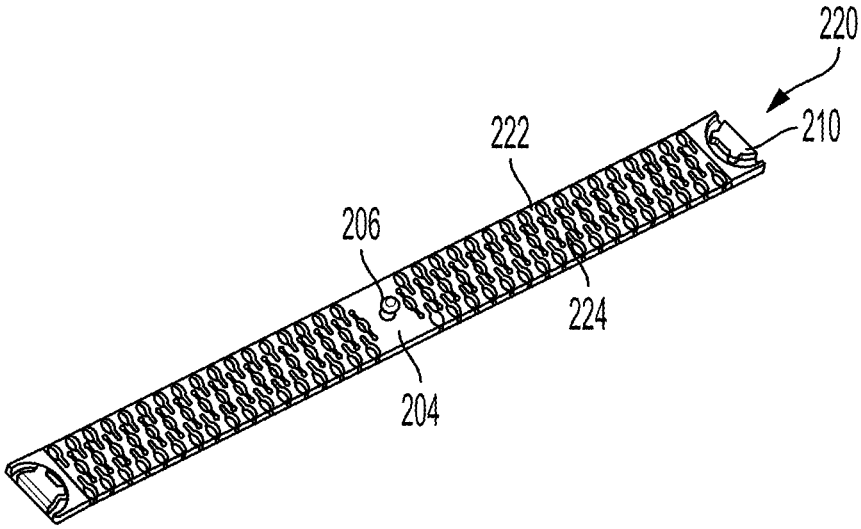
FIG. 6*a-d* illustrate alternative front support members or forehead straps of a helmet closure system.

Referring to FIG. 6*a*, illustrated is an alternative forehead strap 220. The alternative forehead strap 220 is substantially the same as the forehead strap 200 of FIG. 3 and thus, for brevity purposes, a detailed description of the alternative forehead strap 220 is omitted. However, it should be recognized that the description of the forehead strap 200 of FIG. 3 is equally applicable to the alternative forehead strap 220 except where different features are described herein below.

The alternative forehead strap 220 includes lace guides 210 and attachment means 206 as described herein. The alternative forehead strap 220 differs from the forehead strap 200 of FIG. 3 in that the alternative forehead strap 220 includes relief segments 224 that are cut or formed into a main body 222 of the alternative forehead strap 220. The relief segments 224, which may also be referred to as kerf cuts, may have the shape of a pair of attached bowling pins in which each segment has a wide middle portion and smaller opposing end portions that are joined by a narrow neck. The relief segments enable the main body 222 to compliantly stretch or flex as opposing ends of the alternative forehead strap 220 are tensioned via the tension member 150. The relief segments 224 also enable the main body 222 to resiliently return to an untensioned or relaxed shape when tension in the opposing ends of the alternative forehead strap 220 is released. The alternative forehead strap 220 may function essentially identically to the forehead strap 200 of FIG. 3.

Figure 6B:
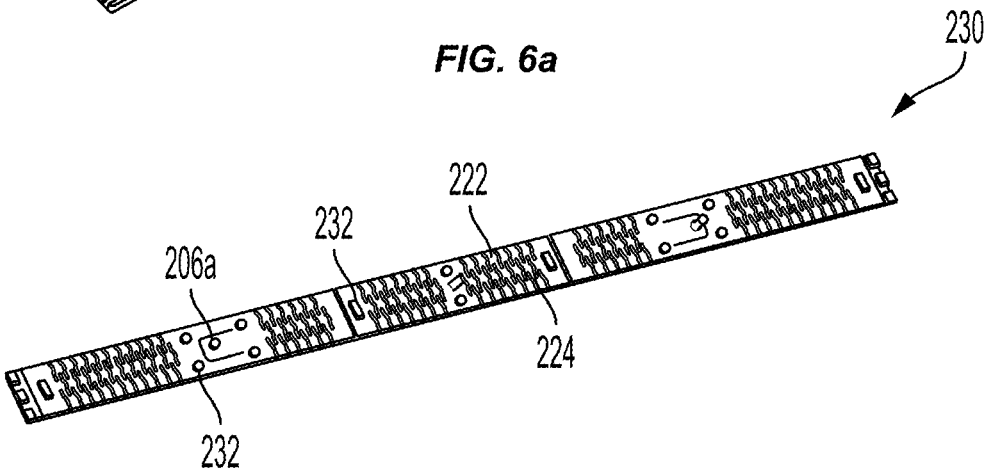

FIG. 6*b* illustrates another alternative forehead strap 230, which is substantially similar to the alternative forehead strap 220 of FIG. 6*a*. For example, the alternative forehead strap 230 of FIG. 6*b* includes relief segments 224 that are formed or cut into the main body 222 of the alternative forehead strap 230. However, instead of a single attachment means 206, the alternative forehead strap 230 includes a plurality of alternative attachment means 206*a* that enable the alternative forehead strap 230 to be attached to a helmet at one or more different positions or locations. The alternative forehead strap 230 may also include guides 232 that are designed to route or direct the tension member 150 along one or more portions of the alternative forehead strap 230. The guides 232 may be designed so that a single portion or segment of the tension member 150 is routed through the guide or may be designed so that multiple portions or segments of the tension member 150 are routed through the guides 232. In some embodiments, the tension member 150 may be routed across or along an entire longitudinal length of the alternative forehead strap 230.

Figure 6C:
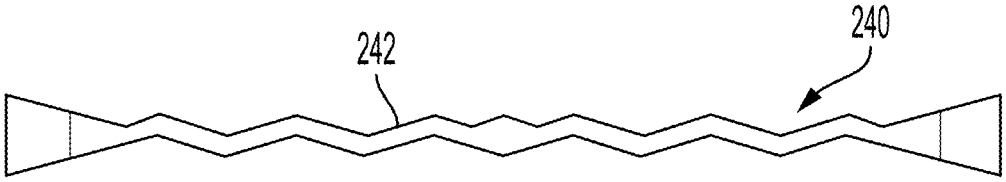
Figure 6D:
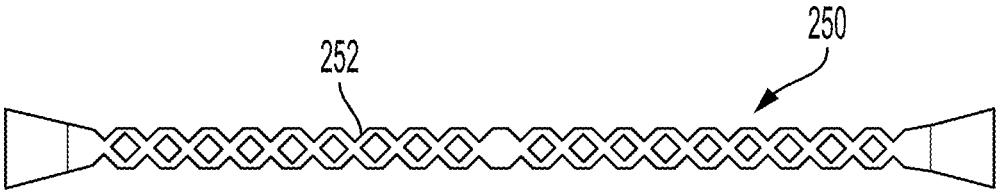

Referring to FIGS. 6*c-d*, illustrated are other alternative forehead straps. The forehead straps of FIGS. 6*c-d* are substantially similar to the forehead straps described herein and thus, for brevity purposes, a general description of the forehead straps is omitted, although the prior descriptions apply equally to the forehead straps of FIGS. 6*c-d*.

The forehead strap 240 of FIG. 6*c* differs from the previously described forehead straps in that the stretch or flex of the forehead strap 240 is achieved via a zig-zag orientation or design of the main strap body 242. The zig-zag design enables the forehead strap 240 to elongate to some degree as opposing ends of the strap are tensioned via the tension member 150. The forehead strap 250 of FIG. 6*d* differs from the previously described forehead straps in that the stretch or flex of the forehead strap 250 is achieved via a diamond shaped or scissor like orientation or design of the main strap body 252. The scissor like shape of the main body 252 enables the forehead strap 250 to flex or stretch in a compliant manner when the opposing ends of the strap 250 are tensioned via the tension member 150. The zig zag and scissor like shapes of the forehead straps, 240 and 250, also enable the respective straps to return to an untensioned or relaxed shape when the tension is released from the opposing ends of the respective straps.

Figure 7A:
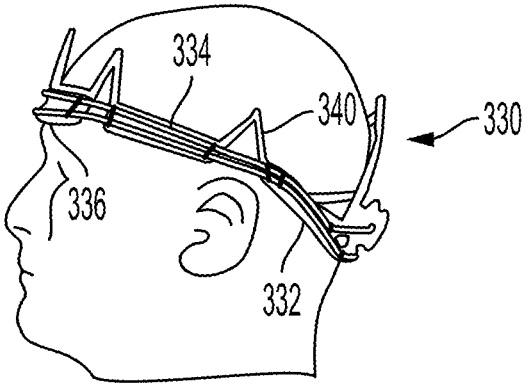
FIGS. 7*a-b* illustrate a second embodiment of a helmet closure system.
Figure 7B:
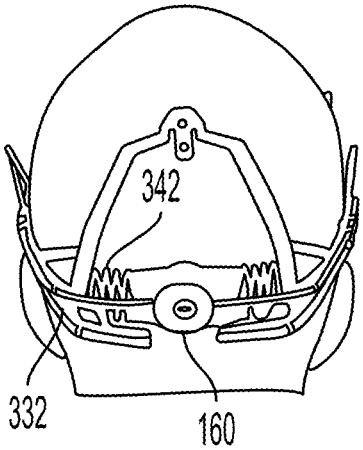

Referring to FIGS. 7*a-b*, illustrated is an alternative closure system 330 that may be used to tighten a helmet about a wearer's head. The alternative closure system 330 is an all-in-one system, which means that unlike the closure system 300 of FIG. 4, the alternative closure system 330 includes a single closure component that encircles the wearer's head. In particular, the alternative closure system 330 includes a rear member or yoke 332, a pair of side members 334, and a forehead member or strap 336 that is positioned between the pair of side members 334. Each of these members (i.e., yoke 332, side members 334, and strap 336) are attached or coupled via a connecting member 340. Because each of the members are connected, the members function as a single closure component that encircles the wearer's head.

In some embodiments, the connecting member 340 may be a V-shaped or triangular shaped piece that is attached to adjacent ends of the respective members. Other connecting members 340 may similarly be employed to connect the individual members together. Each of the members (i.e., yoke 332, side members 334, and strap 336), or one or more of the members, may include relief cuts or kerf cuts 342, which is shown in detail on the yoke 332 of FIG. 7*b*. In some embodiments, the closure device 160 may be positioned on a segment of the yoke 332 that is attached to the yoke 332 on each end or side by kerf cut 342 segments. The relief cuts 342 allow the individual members to flex, move, or bend as described herein in order to conform to the unique shape and size of the wearer's head. In a specific embodiment, each of the members (i.e., yoke 332, side members 334, and strap 336) include relief cuts 342 and thus, each of the members is able to flex and bend about the respective portions of the wearer's head as the headwear is positioned on the head and the tension member 150 is tensioned.

The members (i.e., yoke 332, side members 334, and strap 336) typically include lace guides as described herein that are designed to route, direct, or guide the tension member 150 along a path about the respective members. The tension member 150 may fully encircle the wearer's head, such as by traversing the longitudinal length of each of the members (i.e., yoke 332, side members 334, and strap 336), or the tension member may extend from the yoke 332, across the side members 334, and to opposing ends of the strap 336. Each of the members (i.e., yoke 332, side members 334, and strap 336) may include attachment means as described herein to couple the closure system with the helmet. In other instances, only the yoke 332 and strap 336 may include attachment means so that the yoke 332 and strap 336 are coupled with the helmet while the side members 334 are relatively free floating within the helmet.

Figure 8:
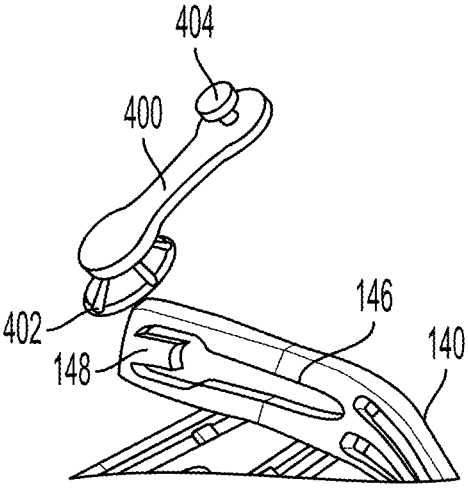
FIG. 8 illustrates a coupling member that may be used to couple one or more of the components of the closure system to a helmet.

Referring to FIG. 8, illustrated is an embodiment of a coupling member 400 that may be used to couple one or more of the components of the closure system to a helmet. The coupling member 400 includes a first end, a second end, and an elongate body that extends from the first end to the second end. The first end includes an anchor 402 that is designed to be attached or coupled to the helmet. The anchor may be any attachment component or means known in the art for coupling components or pieces to headwear. The second end likewise includes coupling means 404 that is designed to attach to the component of the closure system. In the illustrated embodiment, the coupling means 404 is a post or boss that may be snap-fit coupled to the component of the closure system. In other embodiments, the coupling means 404 may include a snap button, magnetic component, hook and loop fastener, and the like.

In the illustrated embodiment, the boss, which represents the coupling means 404 (hereinafter boss 404) is designed to snap-fit couple with an elongate slot 146 of the closure system's component, which in the illustrated embodiment is the distal portion 140 of the yoke arm 114. It should be understood that the elongate slot 146 may likewise be employed on the forehead straps and/or side members described herein and thus, the description provided herein applies equally to those components.

The elongate slot 146 includes a distal end and a proximal end. The boss 404 is insertable within the distal end of the slot 146 and is slidable proximally into the proximal end of the slot 146. The boss 404 may include a cap that is substantially wider than a main body of the boss 400. The distal end of the slot 146 is wider than the cap of the boss 404 and the slot 146 narrows toward the proximal end so that a width of the slot 146 at the proximal end is narrower than the width of the cap 404. In this manner, sliding the boss 404 proximally within the slot 146 locks the boss within the slot 146. The distal end of the slot 146 may include a tab 148 that extends into the distal end of the slot 146 and that is configured to engage the boss 404 to prevent accidental or unwanted removal of the boss 404 from the slot 146.

Figure 9:
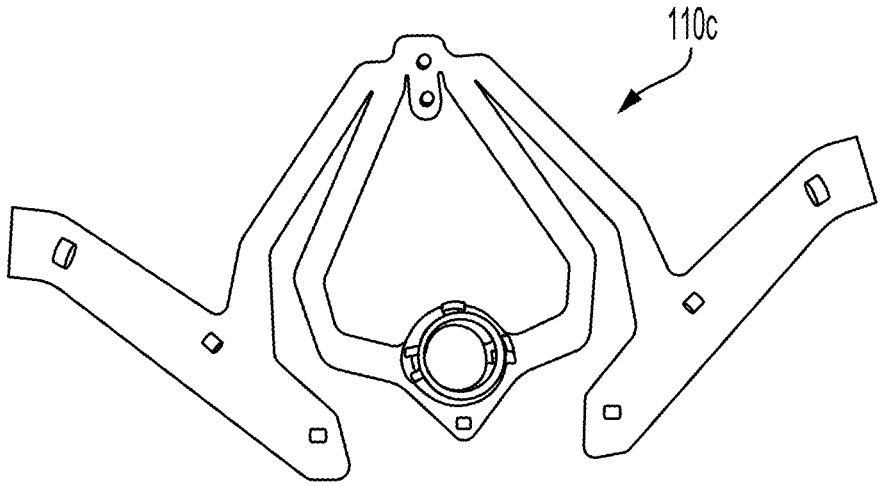
FIG. 9 illustrates a fourth embodiment of a rear support or yoke of a helmet closure system.

Referring to FIG. 9, illustrated is another alternative yoke 110*c*. The alternative yoke 110*c* of FIG. 9 is identical to the yoke 110 of FIG. 1 except that the distal portion 140 of each arm 114 is removed. Thus, the alternative yoke 110*c* has a substantially shorter arm length in comparison with the yoke 110 of FIG. 1. The alternative yoke 110*c* may be identical to the yoke 110 of FIG. 1 other than this difference.

Figure 10A:
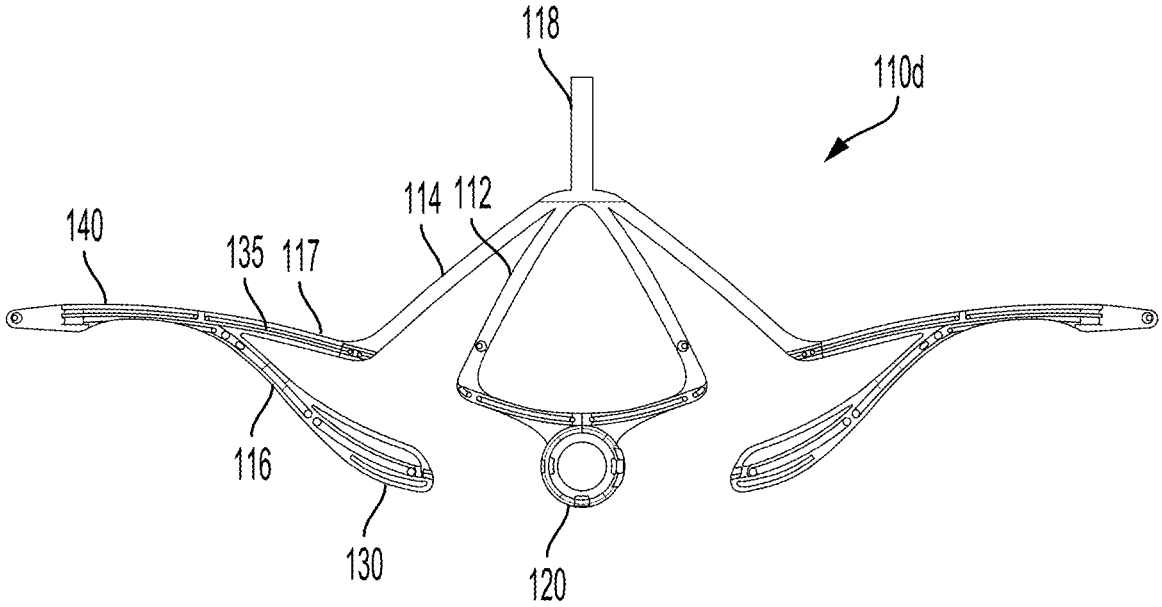
FIGS. 10*a-c* illustrate a fifth embodiment of a rear support or yoke of a helmet closure system.
Figure 10B:
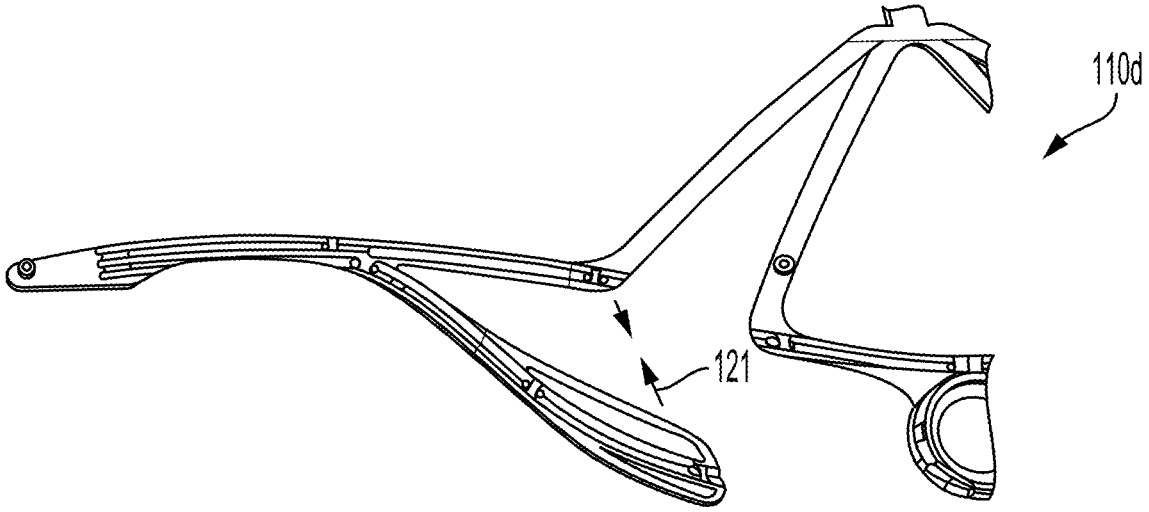
Figure 10C:
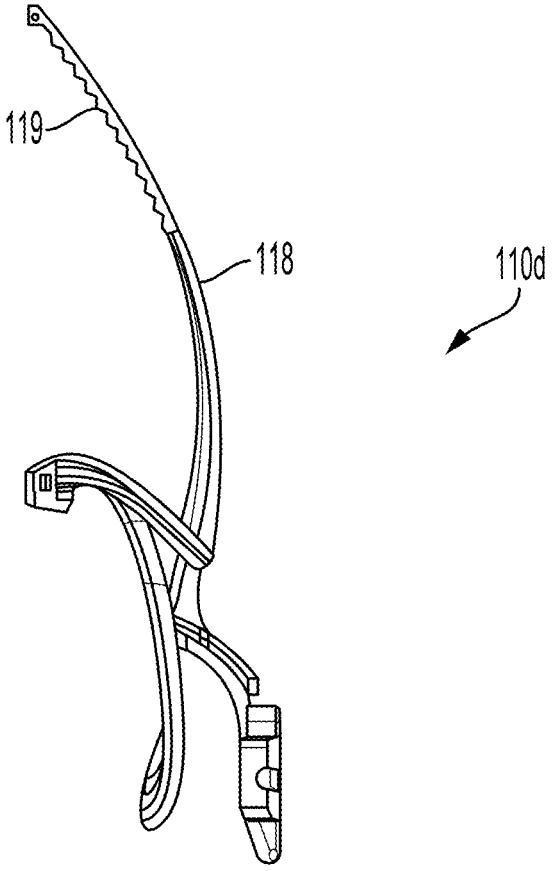

FIG. 10*a-c* illustrates another alternative design of a yoke 110*d*. The alternative yoke 110*d* is substantially similar to the yoke 110*b* of FIG. 5 and thus, for brevity purposes, a detailed description of the alternative yoke 110*d* is omitted. However, it should be recognized that the description of the yoke 110*b* of FIG. 5 is equally applicable to the alternative yoke 110*d* of FIG. 10*a-c* except where different features are described herein below.

One difference between the yoke 110*d* of FIG. 10*a* and the yoke 110*b* of FIG. 5 is the inclusion of attachment member 118 positioned at and extending from the upper end of the center member 112 adjacent to the coupling point of the center member 112 and pair of arms 114. In the illustrated embodiment, the attachment member 118 is a thin rectangularly shaped segment that extends from the center member 112. The attachment member 118 includes adjustment means 119 (shown in FIG. 10*c*) that are positioned on at least a portion of the attachment member 118, typically on an inner surface of the attachment member 118. The adjustment means 119 are configured to engage with corresponding receiving adjustment means (not shown) on an inner surface or portion of the helmet. The adjustment means 119 could include any suitable adjustment features, such as the longitudinally aligned grooves or recesses shown in FIG. 10*c*, or other adjustment features such as hook and loop features, magnetic features, snaps, bead and cords, and the like. The adjustment means 119 enable the yoke 110*d* to be adjusted relative to the helmet so that the yoke 110*d* is positioned differently about the wearer's head for comfort and/or fit purposes. Specifically, the adjustment means 119 enable the yoke 110*d* to be moved vertically relative to the helmet.

Another difference between the yoke 110*d* of FIG. 10*a* and the yoke 110*b* of FIG. 5 is the overall shape of the yoke 110*d* and the resulting path defined by the channels 135 formed within one or more of the beam 117, the proximal portion 116, the distal portion 140, the bottom portion 130, and/or the bottom end of the center member 112. A gap 121 (shown in FIG. 10*b*) is formed between the beam 117 and the proximal portion 116 and bottom end 130. The gap 121 may allow the proximal portion 116 and bottom end 130 to move, flex, bend, or otherwise conform to the wearer's head to a greater degree than the yoke 110*b* of FIG. 5. As illustrated in FIG. 10*b*, the gap 121 may allow the bottom end 130 to move or flex toward the beam 117 to some degree, thereby enabling greater conformity to a wearer's head. The channel 135 is formed along the bottom end of the center member 112 and is generally aligned with the beam 117 and distal portion 140. The channel 135 that is formed or defined on the center member 112 is positioned above the base member 120. The base member 120 extends downward from the center member 112, resulting in lace ports of the base member 120 being generally aligned with the bottom end 130 of each arm. Alignment of the lace ports and bottom end 130 of each arm allows a tension member to be routed directly from the reel based closure device to the channels 135 formed in the bottom end 130 of each arm. The beam 117, proximal portion 116, distal portion 140, bottom portion 130, and/or bottom end of the center member 112 may also be curved to remove sharp bends and sharp corners, thus improving the routing, guiding, and directing of the tension member along the channels 135, as well as improving the overall conformity of the yoke 110*d* to the wearer's head.

FIG. 11*a-e* illustrates an alternative forehead strap 260 and mounting piece 261. The alternative forehead strap 260 is similar to the forehead strap 200 of FIG. 3 and thus, for brevity purposes, a detailed description of the alternative forehead strap 260 is omitted. However, it should be recognized that the description of the forehead strap 200 of FIG. 3 is equally applicable to the alternative forehead strap 260 except where different features are described herein below.

A difference between the forehead strap 260 and the forehead strap 200 of FIG. 3 is that the forehead strap 260 is constructed to have a wavy pattern that forms or defines one or more openings 214. The openings 214 are positioned longitudinally along the forehead strap 260 and on opposing sides of the forehead strap 260 in an alternating fashion. The openings 214 may have a generally parabolic shape with a circular center, tapered midsection and outwardly flared ends. This construction results in the forehead strap 260 having or defining a plurality of generally semi-circular segments 212 along its longitudinal length. The openings 214 and semi-circular segments 212 allow the forehead strap 260 to flex or move to some degree in an accordion like fashion. One or more of the openings 214 positioned at or near the center portion of the forehead strap 260 may be filled in to increase the coupling of the forehead strap 260 to the mounting piece 261 by increasing the retention of the mounting piece 261 within a centermost positioned opening 214. Specifically, the filled in openings stiffen the centermost positioned opening 214 by not enabling the semi-circular segments 212 positioned on opposing sides of the centermost positioned opening 214 to move or flex in an accordion like manner. Additionally, one or openings 214 located at or near the ends of the forehead strap 260 may also be filled in. In some instances, the filled in openings 214 may include smaller cutouts or openings 215, which promote or enable some degree of stretch and/or conformity of the forehead strap 260 at or near the filled in openings to reduce stress concentrations. The filled in openings 214 may also provide larger surface areas 219 that may be useful to incorporate additional attachment means, such as adhesive, hook and loop fastener, magnetic fastener, friction-fit, or the like.

Another difference is the inclusion of the mounting piece 261, which may be removably secured to an inner surface or portion of the helmet. The mounting piece 261 may include attachment means 206 for engaging with an opening 214 of the forehead strap 260. One or more of the semi-circular segments 212 may have a recessed edge 216 that extends at least partially around the inner periphery of the respective opening 214. In the illustrated embodiment, the recessed edge 216 extends around the entire inner periphery of the opening 214. The recessed edge 216 may also be formed or positioned on openings 214 on opposing sides of the forehead strap 260. The recessed edge 216 may facilitate engagement of the attachment means 206 with one of the openings 214 and/or aid in securing the attachment means 206 within the opening.

In the illustrated embodiment, the attachment means 206 is a protrusion that is shaped and sized to correspond with the shape and size of the openings 214. Specifically, the shape of the attachment means 206 is inverse that of the openings 214. For example, the openings 214 and attachment means 206 may each have a generally parabolic shape with a circular portion, a tapered midsection, and flared end. The corresponding inverse shape and size of the attachment means 206 (e.g., protrusion) and openings 214 allows the attachment means 206 to fit within and engage one of the openings 214 in a keyed, locking or fastening type manner. Exemplary locking and fastening shapes include a sliding dovetail, t-slot, flanged slot, and the like. The attachment means 206 described hereinbelow may be substituted for protrusion 206.

In the illustrated embodiment, the attachment means 206 protrusion has a circular shaped head and a hyperbolic shaped base. The circular shaped head is positioned near a center of the mounting piece 261 and the base extends from the circular shaped head toward one end of the mounting piece 261. The base tapers or flares as it extends from the circular shaped head so that the base is narrowest at the circular shaped head and is widest at or near the end of the mounting piece 261. An upper end or surface of the circular shaped head and/or hyperbolic shaped base includes a lip or flange that extends around the periphery of the circular shaped head and/or hyperbolic shaped base. The lip or flange is shaped and sized to correspond with the recessed edge 216 so that when the attachment means 206 is positioned within an opening 214, the lip or flange is positioned within the recessed edge 216. Positioning of the lip or flange within the recessed edge 216 further secures the attachment means 206 within the openings 214. The openings 214 and mounting piece 261 are shaped and sized so that insertion of the mounting piece 261 within one of the openings 214 restricts and/or inhibits rotation of the forehead strap 260 about the mounting piece 261 in at least one plane, such as a plane that is parallel to the surface 219 of the forehead strap 260. For example, in FIG. 11*a*, the insertion of the mounting piece 261 within the opening 214 may restrict and inhibit clockwise and counterclockwise rotation of the forehead strap 260 about or relative to the mounting piece 261.

The forehead strap 260 may be removably attached to the mounting piece 261 by sliding or inserting the attachment means 206 into an opening 214 of the forehead strap 260. Inserting the attachment means 206 into the opening 214 causes the opening 214 to flex or widen slightly as the larger sized circular head is inserted through the narrower sized tapered midsection of the opening 214. In some embodiments, the mounting piece 261 includes a stop member 208 positioned near an upper end of the mounting piece 261 opposite the hyperbolic shaped base. The stop member 208 is positioned on the mounting piece 261 so that it is able to snap or fit over an upper end of the forehead strap 260 when the attachment means 206 is inserted within the opening 214 (e.g., see FIG. 11*a*). Snapping or positioning of the stop member 208 over the upper end of the forehead strap 260 fastens or secures the mounting piece 261 to the forehead strap 260. To facilitate snapping of positioning of the stop member 208 over the upper end of the forehead strap 260, the forehead strap 260 may include a tapered recess or groove 207. The tapered recess or groove 207 is configured so that the stop member 208 is able to slide along the tapered recess or groove 207 and over the upper end of the forehead strap 260. A thickness of the attachment means 206 and stop member 208 is typically equal to a thickness of the forehead strap 260 so that when the attachment means 206 is inserted within an opening 214, the mounting piece 261 is approximately flush with the forehead strap 260, thereby preventing pressure points on the wearer's head.

Figure 11A:
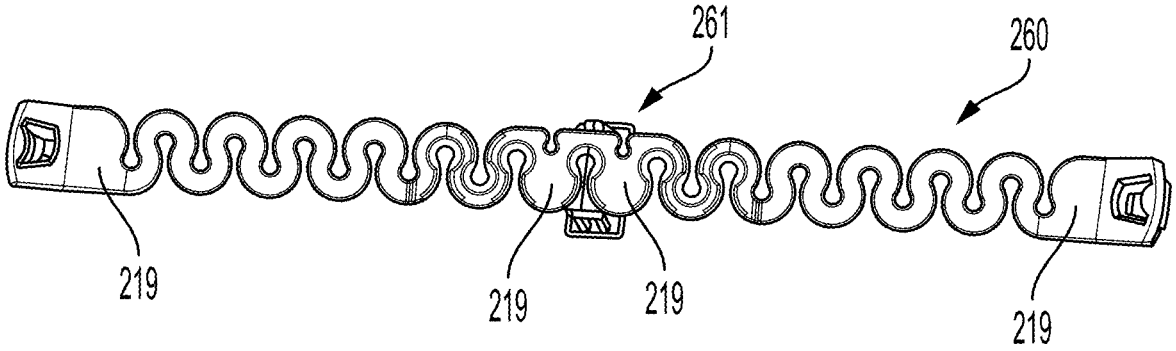
FIGS. 11*a-e* illustrate an alternative front support member or forehead strap of a helmet closure system.
Figure 11B:
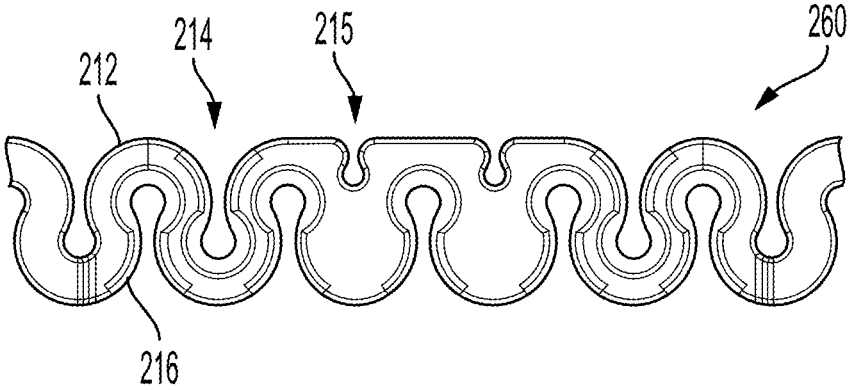
Figure 11C:
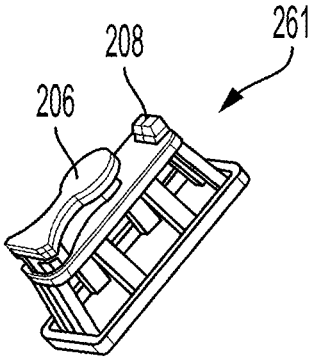
Figure 11D:
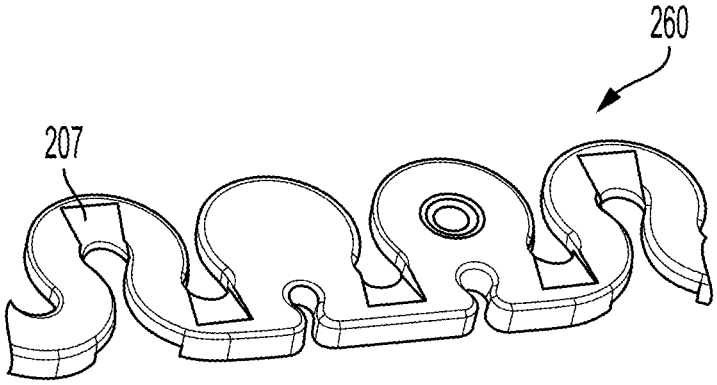
Figure 11E:
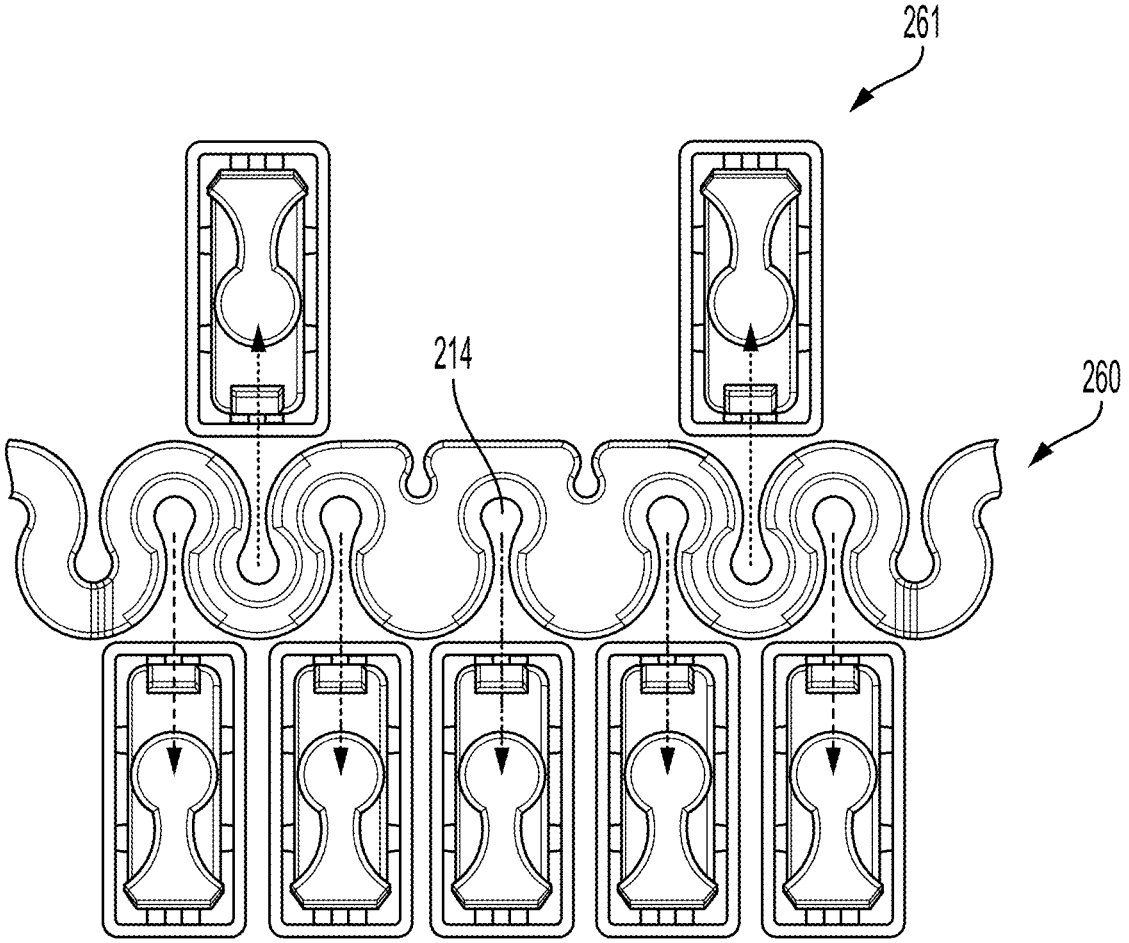

FIG. 11*e* illustrates features that allow the forehead strap 260 to be laterally adjusted relative to the helmet, thereby accommodating for differing helmet designs. Lateral adjustment is achieved via selective attachment of the mounting piece 261 to one of the openings 214. Specifically, the forehead strap 260 may be attached to the mounting piece 261 via a centermost opening 214 or one of the laterally outward positioned openings 214. FIG. 11*e* illustrates the forehead strap 260 including seven different openings that are configured to attachment to the mounting piece 261, although more or fewer openings may be configured for such attachment. In addition, because some of the openings 214 are positioned on opposing sides of the forehead strap 260 in an alternating fashion, the forehead strap 260 and/or the mounting piece 261 may be rotated 180 degrees, thereby enabling a greater degree or number of attachment configurations of the mounting piece 261 and forehead strap 260. Additionally, multiple mounting pieces 261 may be removably secured to an inner surface or portion of the helmet, allowing for dual-mount configurations or other multi-mount configurations. For example, the forehead strap 260 may be attached via two mounting pieces 261 at two of the laterally outward positioned openings 214. In such instances, the forehead strap 260 may be attached to the helmet via one mounting piece 261 or two or more mounting pieces 261 to accommodate for multiple designs. Each of the openings 214 that are designed for coupling with the mounting piece 261 may include the tapered recess or groove 207.

In an alternative design, any of the forehead straps described herein may be made of an auxetic material such that when stretched or tensioned, the forehead strap widens laterally or perpendicular to its longitudinal length. This widening of the forehead strap increases the surface area of the strap for greater pressure distribution across the wearer's head. The auxetic material of the forehead strap may be a textile material. In other instances, the forehead strap may have variable stiffness along its longitudinal length.

In some embodiments, the yokes described herein may not be coupled or anchored with the helmet. Rather, the yokes may be relatively free floating within the helmet, which may allow the yoke to have increased translational freedom within the helmet. Specifically, the yoke arms may be able to translate anteriorly and posteriorly to a greater extent and/or the entire yoke assembly may translate towards the front of the helmet to a greater extent to generate system compression. This may allow the system to better conform to a wider range of head sizes and shapes.

While several embodiments and arrangements of various components are described herein, it should be understood that the various components and/or combination of components described in the various embodiments may be modified, rearranged, changed, adjusted, and the like. For example, the arrangement of components in any of the described embodiments may be adjusted or rearranged and/or the various described components may be employed in any of the embodiments in which they are not currently described or employed. As such, it should be realized that the various embodiments are not limited to the specific arrangement and/or component structures described herein.

In addition, it is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A rear support of a helmet closure system, the rear support being positionable at a rear of a helmet and being configured to engage a back of a wearer's head, the rear support comprising:

a central frame having an upper end and a lower end, the lower end including a base member of a reel based closure device;

a pair of arms that are attached to the central frame at the upper end of the central frame, each arm of the pair of arms including one or more guides that are configured to direct or route a tension member of the reel based closure device along a path; and attachment means that are positioned at the upper end of the central frame, the attachment means enabling the rear support to be coupled with the helmet; wherein:

each arm of the pair or arms is attached to the central frame only at the upper end so that the lower end of the central frame is separated from a lower end of each arm;

each arm of the pair of arms includes a distal end that extends away from the central frame so as to encircle a portion of the wearer's head when the helmet is being worn;

the central frame and pair of arms are formed of thin and flat polymer materials that enable the central frame and pair of arms to lie flat against and conform to the back of the wearer's head;

each arm of the pair of arms includes a gap between a first arm segment and a second arm segment; and the second arm segment is attached to the first arm segment near a midpoint thereof, and wherein the second arm segment extends from the first arm segment toward the lower end of the central frame so that an end of the second arm segment is vertically separated from the first arm segment.

2. The rear support of claim 1, wherein the central frame and the pair of arms are curved in a first plane and are curved in a second plane that is orthogonal to the first plane.

3. The rear support of claim 1, wherein the second arm segment of each arm is positioned with respect to the base member of the central frame such that lace ports of the base member are aligned with the second arm segment of each arm.

4. The rear support of claim 1, wherein the attachment means are positioned on a thin rectangularly shaped segment that extends from the upper end of the central frame.

5. The rear support of claim 4, wherein the attachment means comprise one or more bosses or posts, grooves or recesses, a hook and loop fastener, a magnet, a button, or an adhesive.

6. A rear support of a helmet closure system, the rear support comprising:

a frame having an upper end and a lower end, the lower end including a base member of a reel based closure device;

a pair of arms that are attached to the frame at the upper end thereof, each arm of the pair of arms including one or more guides that are configured to direct or route a tension member along a path; and attachment means that are positioned at the upper end of the frame, the attachment means enabling the rear support to be coupled with a helmet;

wherein a lower end of each arm is separated from the lower end of the frame; and wherein each arm of the pair of arms includes a gap between a first arm segment and a second arm segment.

7. The rear support of claim 6, wherein the frame and the pair of arms are curved in a first plane and in a second plane.

8. The rear support of claim 6, wherein the second arm segment is attached to the first arm segment near a midpoint thereof, and wherein the second arm segment is vertically separated from the first arm segment.

9. The rear support of claim 8, wherein the second arm segment of each arm is positioned such that lace ports of the base member are aligned with the second arm segment of each arm.

10. The rear support of claim 6, wherein the second arm segment is attached to the first arm segment at a distal end thereof.

11. The rear support of claim 6, wherein the attachment means are positioned on a thin rectangularly shaped segment that extends from the upper end of the frame.

12. The rear support of claim 11, wherein the attachment means comprise one or more bosses or posts, grooves or recesses, a hook and loop fastener, a magnet, a button, or an adhesive.

* * * * *